US008662933B2

(12) United States Patent
Wu

(10) Patent No.: US 8,662,933 B2
(45) **Date of Patent: *Mar. 4, 2014**

(54) CABLE CONNECTOR ASSEMBLY WITH IMPROVED CONTACTS AND SPACER WITH A GATEWAY

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/328,899

(22) Filed: Dec. 16, 2011

(65) Prior Publication Data

US 2012/0156941 A1 Jun. 21, 2012

(30) Foreign Application Priority Data

Dec. 16, 2010 (CN) ..... 2010 1 0591382

(51) Int. Cl.
*H01R 24/00* (2011.01)

(52) U.S. Cl.
USPC ..... 439/660

(58) Field of Classification Search
USPC ..... 439/660, 188, 607.54, 67.55, 607.01
See application file for complete search history.

(56) References Cited

U.S. PATENT DOCUMENTS

| | | | | |
|---|---|---|---|---|
| 7,258,565 | B2 * | 8/2007 | Huang et al. | 439/353 |
| 7,601,024 | B2 * | 10/2009 | Martich | 439/540.1 |
| 2012/0039574 | A1 * | 2/2012 | Liao et al. | 385/93 |
| 2012/0156940 | A1 * | 6/2012 | Wu | 439/660 |
| 2012/0295482 | A1 * | 11/2012 | Wu | 439/607.54 |
| 2013/0040491 | A1 * | 2/2013 | Wu | 439/607.01 |
| 2013/0040492 | A1 * | 2/2013 | Wu | 439/607.55 |
| 2013/0040493 | A1 * | 2/2013 | Wu | 439/607.55 |

FOREIGN PATENT DOCUMENTS

CN 201323356 10/2009

* cited by examiner

*Primary Examiner* — Chandrika Prasad
(74) *Attorney, Agent, or Firm* — Wei Te Chung; Ming Chieh Chang

(57) ABSTRACT

A cable connector assembly (100) comprises an insulative housing (1), a plurality of contacts (2), a metallic shell (3) enclosing the insulative housing and a spacer (5). The insulative housing includes a first tongue (121) and a second tongue (122). The contacts comprise a plurality of first contacts held in the first tongue and a plurality of second contacts held in the second tongue. At least one of the contacts comprises a main body (2110) located in a vertical plane, a soldering portion (2112) in a horizontal plane and a connecting portion (2114), the spacer has a gateway (5120) recessed backwards, and a rear segment of the main body is inserted into the gateway.

20 Claims, 9 Drawing Sheets

CABLE CONNECTOR ASSEMBLY WITH IMPROVED CONTACTS AND SPACER WITH A GATEWAY

BACKGROUND OF THE INVENTION

1. Field of the Invention

The present invention generally relates to a cable connector assembly, and more particularly to a cable connector assembly transmitting high speed signal.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s).

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

USB 3.0 specification was released and standardized by the USB-IF, a connector in accordance with USB 3.0 standard can provide higher data transmitting efficiency and can be used for external hard disk. A USB 3.0 connector is compatible to standard Universal Serial Bus (USB) 2.0 connector and can support data rate of up to 5 Gbit/s.

As the USB 3.0 connector has two groups of contacts, the USB 3.0 connector has complex structure and the cost of manufacturing thereof will be higher, and it's difficult for assembling. Furthermore, Cross-talk may be occurred between the contacts used for transmitting high speed data.

Further, with the trend of miniaturization, micro USB connectors have been popular, and USB 3.0 connectors comprise a kind of micro USB.

CN patent No. 201323356Y issued to Xiao on Oct. 7, 2009 discloses a cable connector assembly in accordance with USB 3.0 standard, the cable connector assembly comprises an insulative housing, a plurality of contacts received in the insulative housing, a metallic shell enclosing the insulative housing and a pair of latches retained in the insulative housing and exposed out of the metallic shell. Tail portions of the contacts are extending beyond a rear end of the insulative housing to be electrically connected with a cable.

As the trend of miniaturization, some manufacturers design a spacer assembled to the insulative housing with tail portions of contacts disposed in corresponding grooves of the spacer, thus the contacts be solder to cables easily, and cross-talk may be reduced. However combinations between the spacer and the insulative housing and the metallic shell are unstable, while an insulator over-molded on the aforementioned components, the combinations may be broken.

Hence, it is desirable to have an improved structure to overcome the above-mentioned disadvantages of the prior art.

BRIEF SUMMARY OF THE INVENTION

Accordingly, the object of the present invention is to provide a cable connector assembly with improved contacts and spacer.

In order to achieve the above-mentioned object, a cable connector assembly in accordance with the present invention comprises an insulative housing, a plurality of contacts received in the insulative housing, a metallic shell enclosing the insulative housing and a spacer assembled to the insulative housing and supporting the contacts. The insulative housing includes a base portion, a first tongue and a second tongue extending forward from the base portion. The contacts comprise a plurality of first contacts held in the first tongue and a plurality of second contacts held in the second tongue. At least one of the contacts comprises a main body located in a vertical plane, a soldering portion in a horizontal plane and a connecting portion linking the main body with the soldering portion, the main body is extending along a mating direction, the spacer has a gateway recessed backwards, and a rear segment of the main body is inserted into the gateway.

Other objects, advantages and novel features of the invention will become more apparent from the following detailed description of the present embodiment when taken in conjunction with the accompanying drawings.

DETAILED DESCRIPTION OF THE INVENTION

Figure 1:
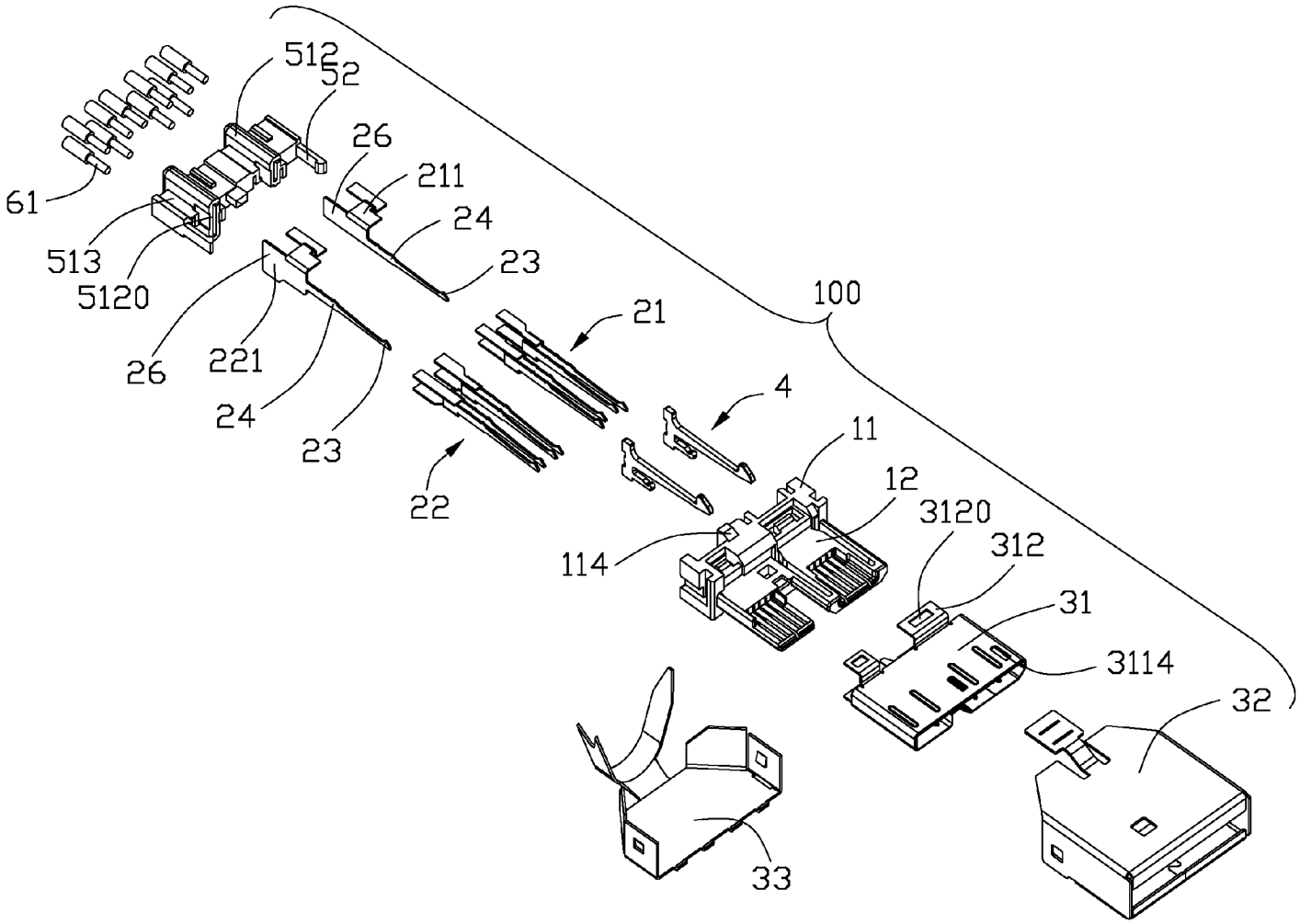
FIG. 1 is an exploded perspective view of a cable connector assembly in accordance with the present invention.

Reference will now be made to the drawing figures to describe the present invention in detail.

Figure 2:
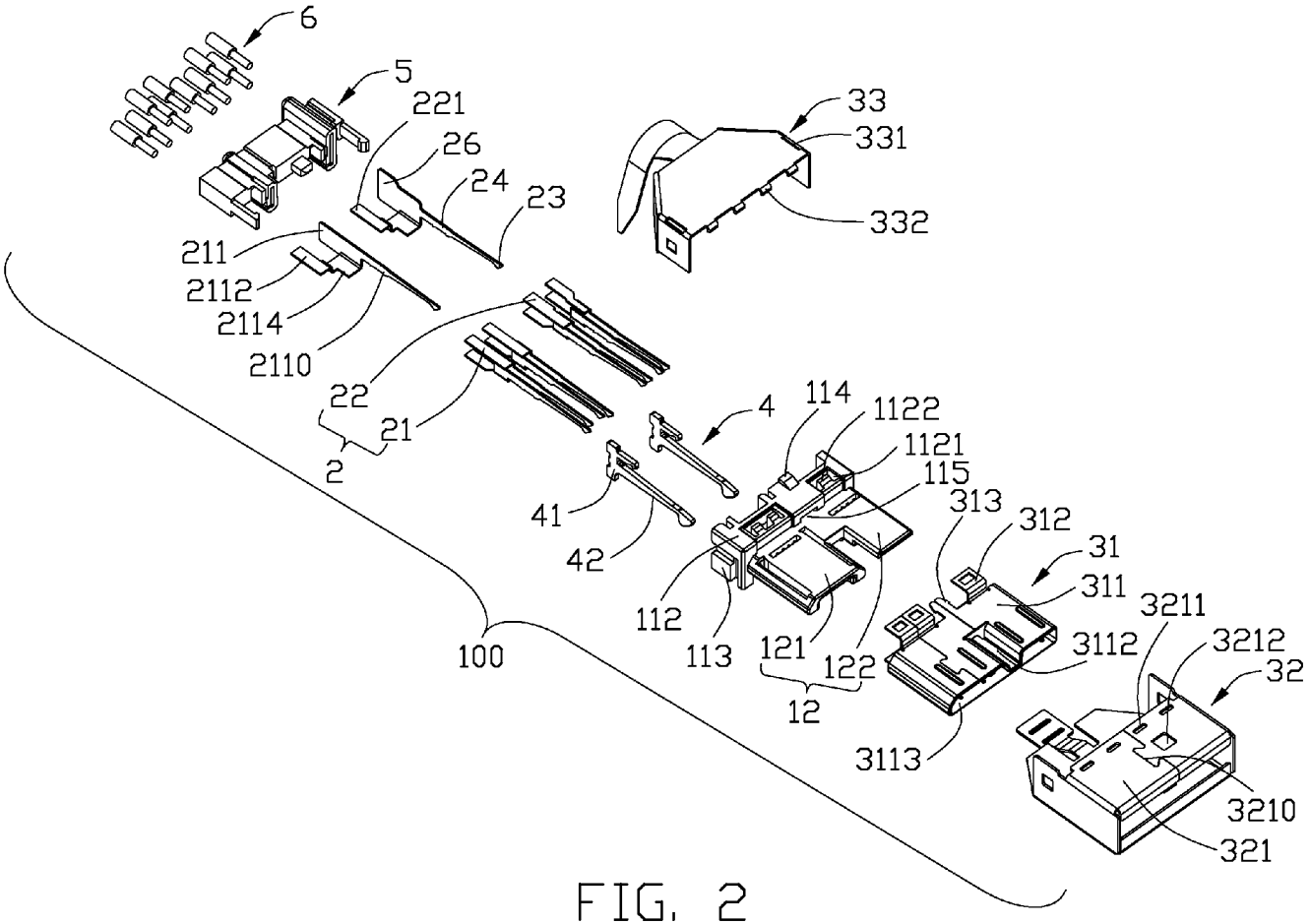
FIGS. 2-3 are views similar to FIG. 1, but viewed from different aspects.
Figure 3:
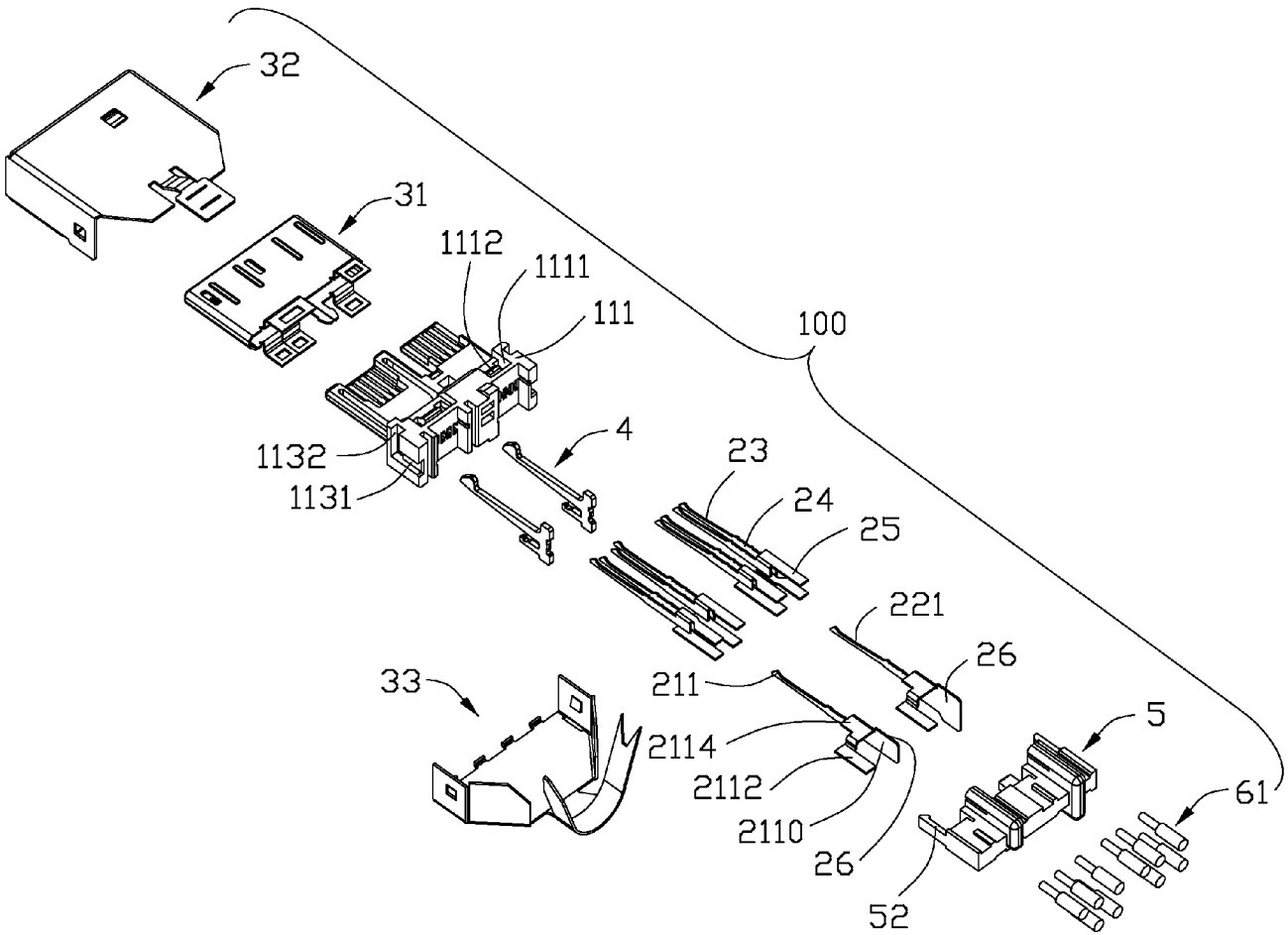
Figure 4:
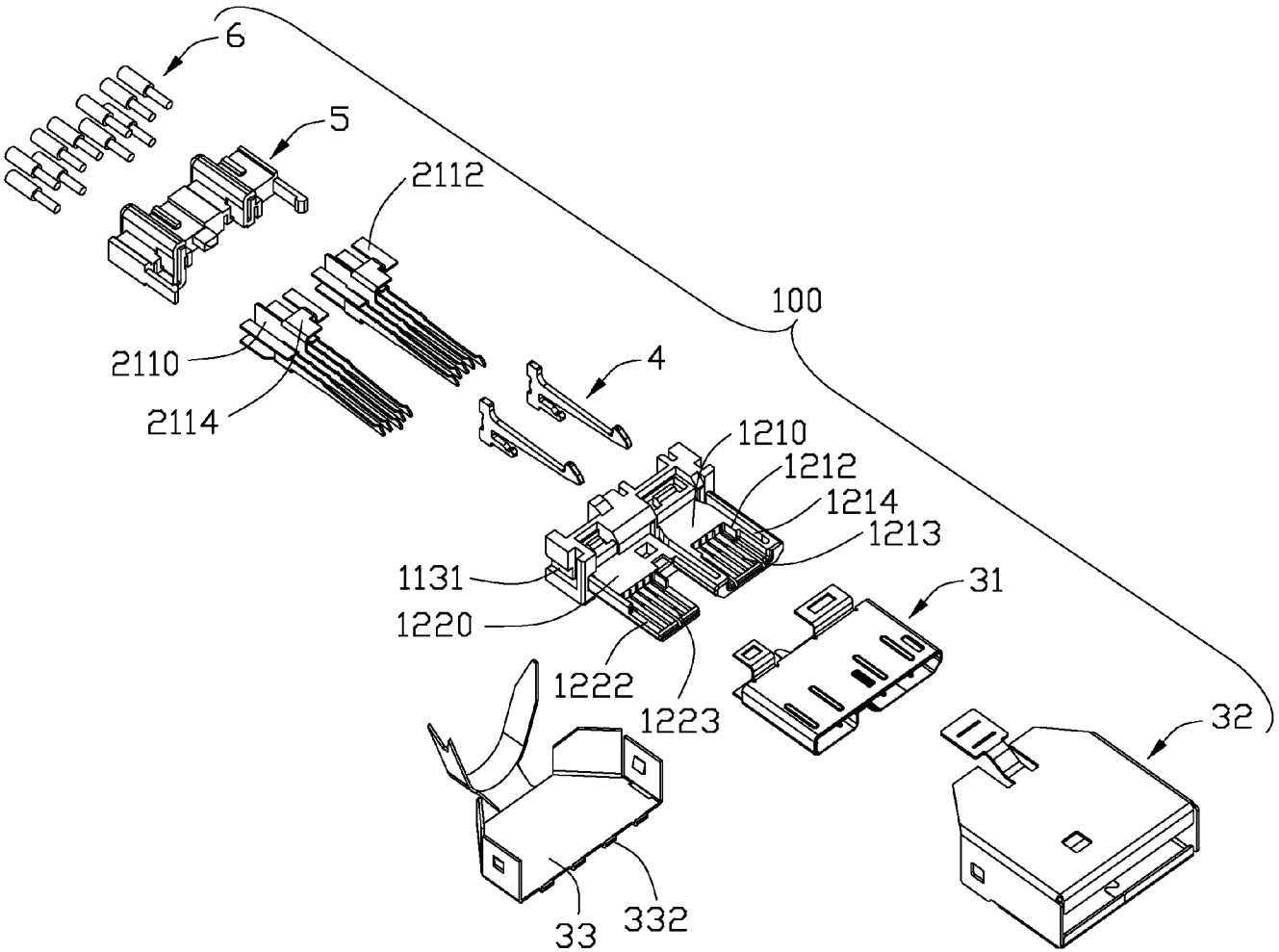
FIG. 4 is another exploded perspective view of the cable connector assembly shown in FIG. 1.
Figure 5:
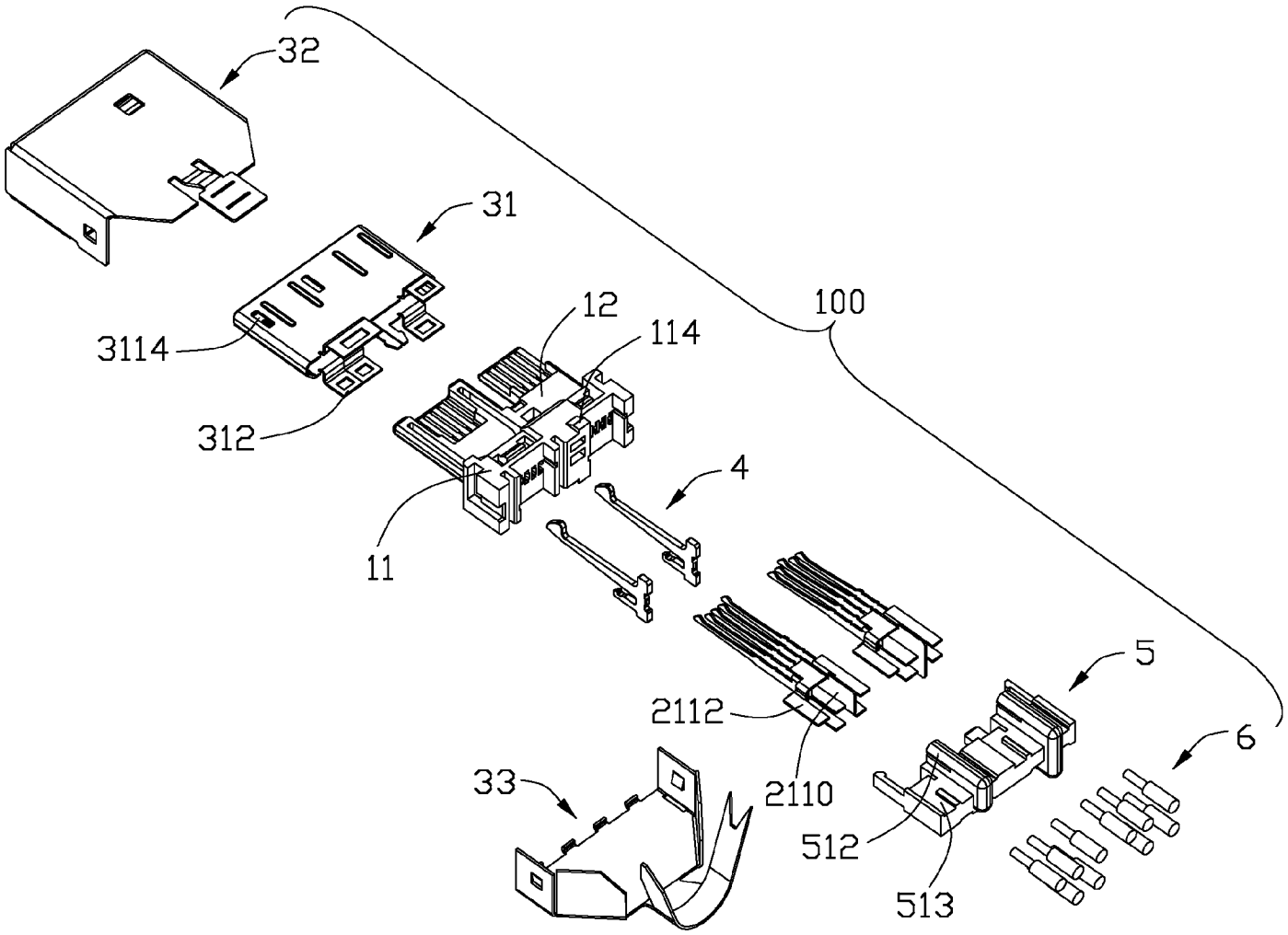
FIG. 5 is a view similar to FIG. 4, but viewed from a different angle.
Figure 6:
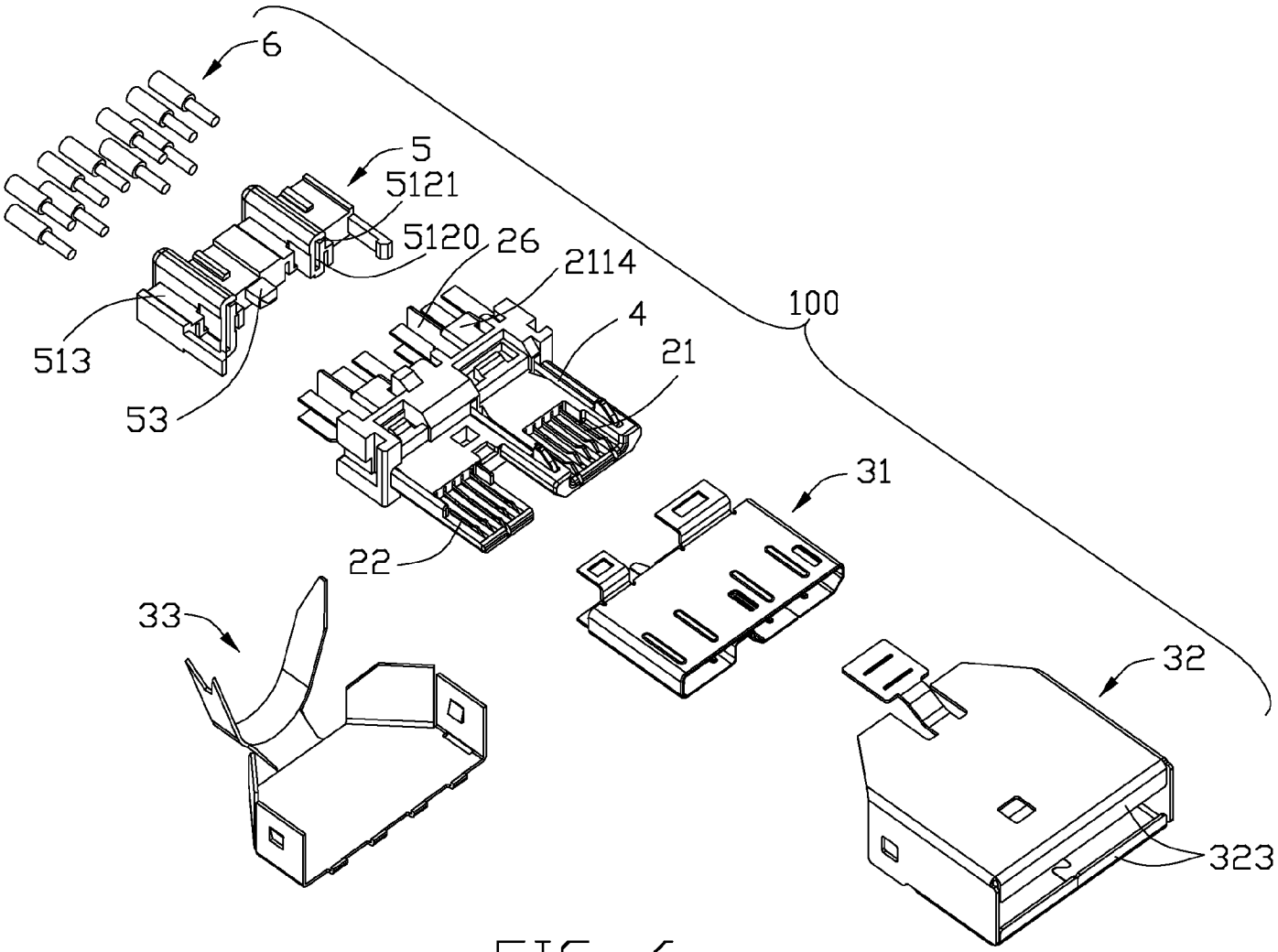
FIG. 6 is a partially assembled view of FIG. 1.
Figure 7:
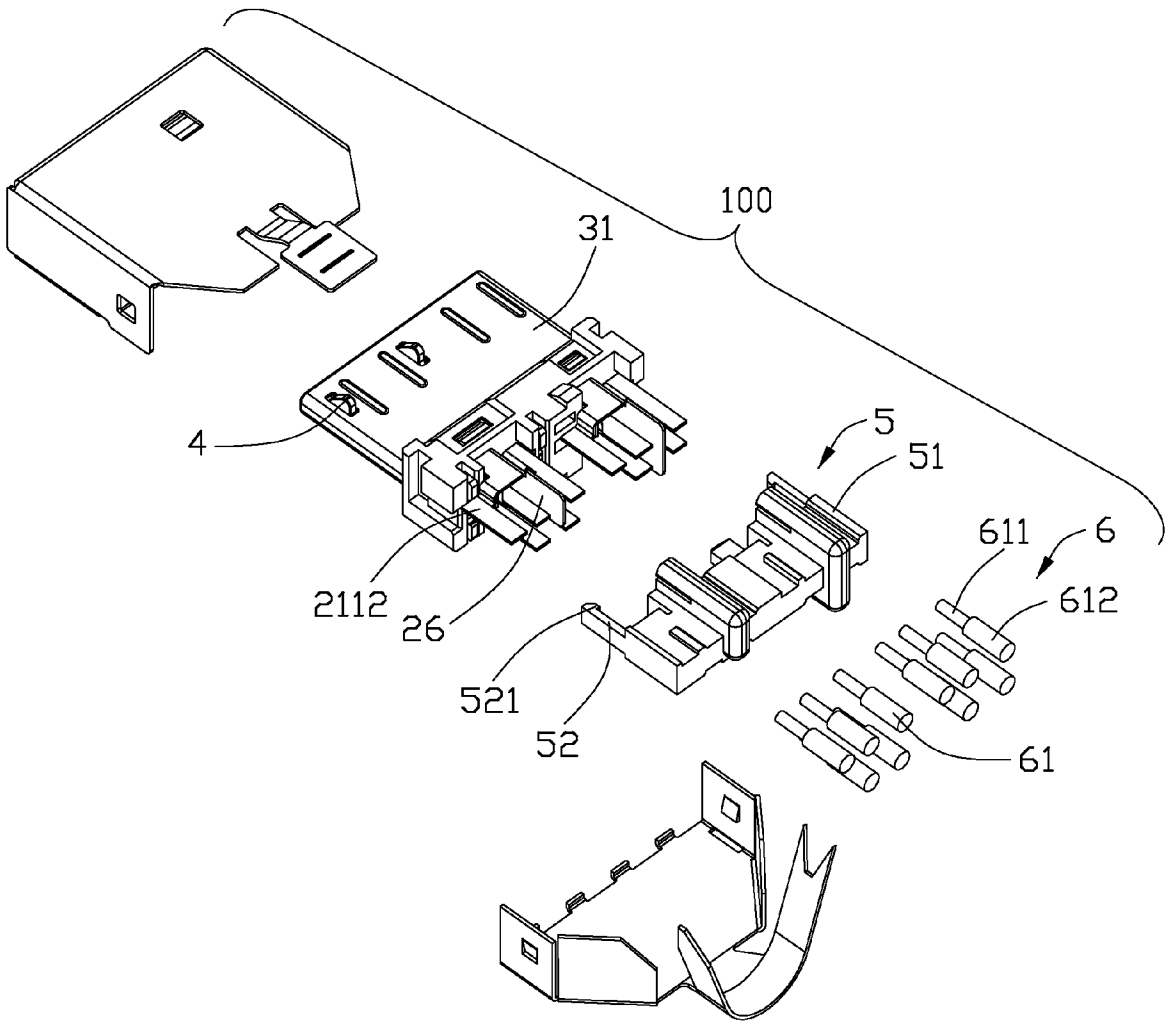
FIG. 7 is a further assembled view of FIG. 6.
Figure 8:
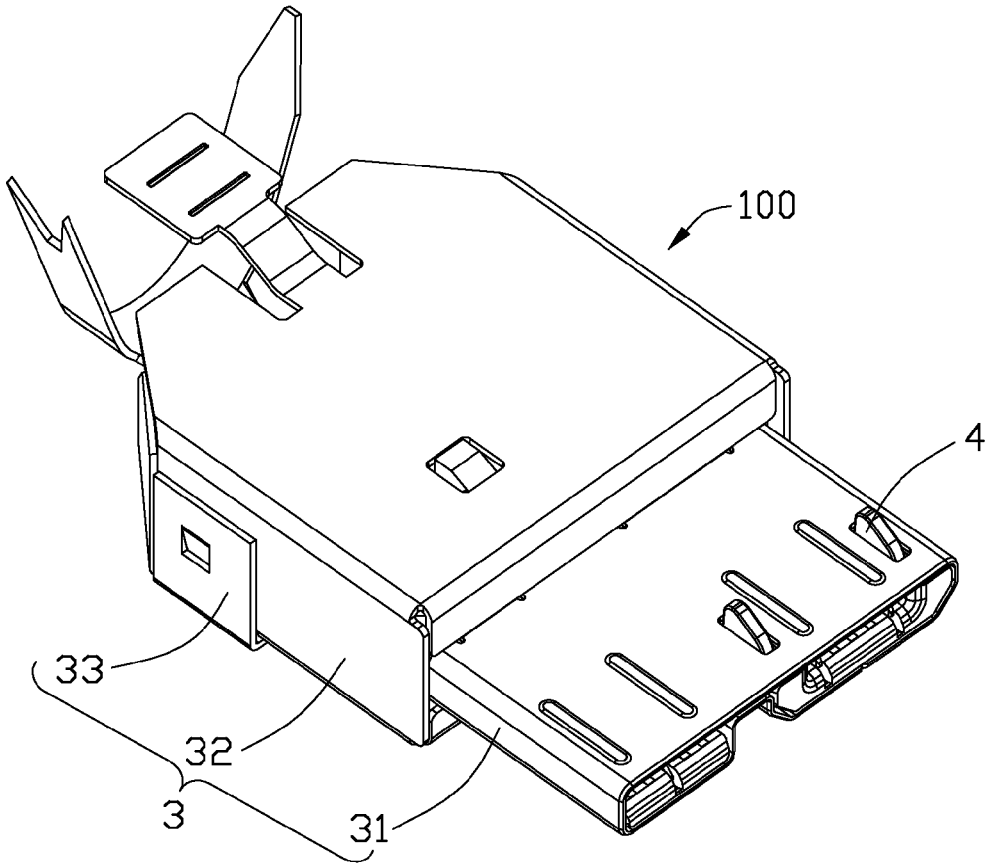
FIGS. 8-9 are assembled perspective views of the cable connector assembly shown in FIG. 1.
Figure 9:
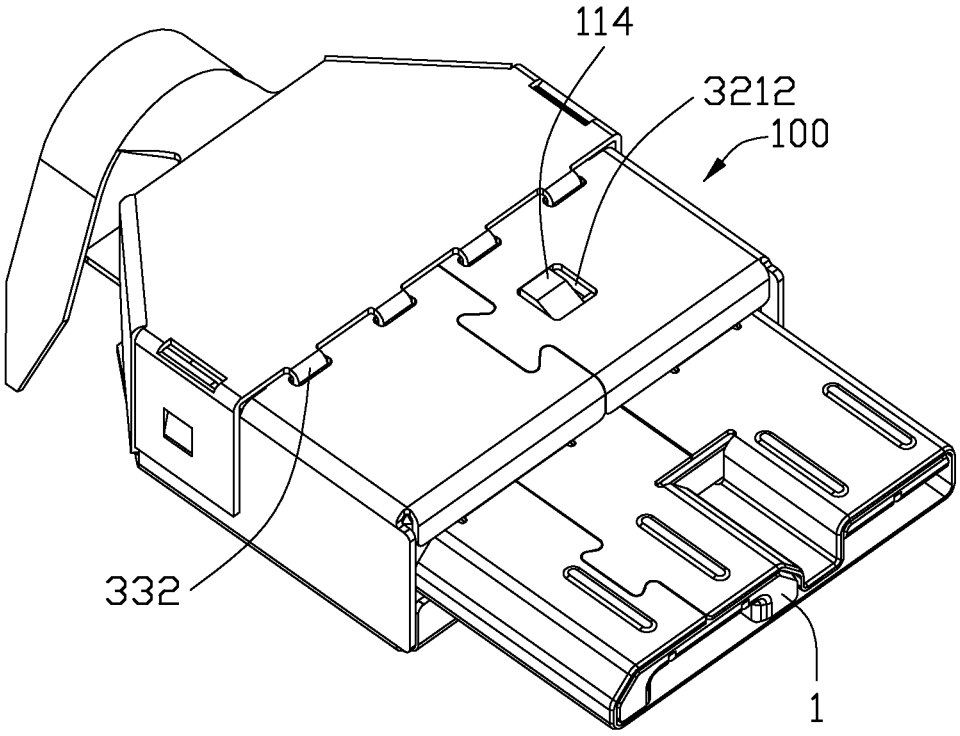

Referring to FIGS. 1-3 and conjunction with FIGS. 8-9, a cable connector assembly 100 made in accordance with the present invention comprises an insualtive housing 1, a plurality of contacts 2 held in the insulative housing 1, a metallic shell 3 enclosing the insualtive housing 1, a pair of latches 4 retained in the insulative housing 1 and exposed out of the metallic shell 3, a spacer 5 fastened to the insulative housing 1 to support contacts 2 and a cable 6 electrically connected with the contacts 2.

Referring to FIGS. 2-9, the insulative housing 1 includes a base portion 11 and a tongue portion 12 integrally extending forwardly beyond the base portion 11. The tongue portion 12 is split into a first tongue 121 and a second tongue 122 side by side arranged with each other and disposed in a common plane. The first tongue 121 is wider than the second tongue 122. The base portion 11 comprises a bottom surface 111, a top surface 112 and a pair of lateral walls 113, the bottom surface 111 defines a pair of first openings 1111 with different sizes, and each first opening 1111 has a first tab 1112 therein. The top surface 112 defines a pair of second openings 1121 with different sizes, and each second opening 1121 has a second tab 1122 therein. Each lateral wall 113 defines a first slot 1131 along a mating direction and a second slot 1132 perpendicular to the first slot 1131. The second slot 1132 is communicated with the first slot 1131 and deeper than the first slot 1131. The base portion 11 defines a pair of third tabs 114 on the bottom surface 111 and the top surface 112 respectively, and the third tabs 114 are neighboring to a back end of the base portion 11. The base portion 11 defines a locking hole 115 recessed rearwards from a front end thereof, and the locking hole 115 is neighboring to the tongue portion 12.

The first tongue 121 and the second tongue 122 are located side by side with corresponding bottom surfaces (not labeled) on a same horizontal level, to make sure the cable connector assembly 100 with a low profile, and the size of the first tongue 121 is accordance with USB 2.0 standard. The first tongue 121 has a first rear segment 1210 mechanically connected with the base portion 11 and a first front segment 1212 away from the base portion 11. Relative to the first tongue 121, the second tongue 122 defines a second rear segment 1220 and a second front segment 1222. The first rear segment 1210 and the second rear segment 1220 are of a unitary configuration to make the tongue portion 12 stable, and the first front segment 1212 and the second front segment 1222 are spaced apart from each other to form two independent mating ports.

The first tongue 121 defines a plurality of first passages 1213 parallel to one another along a transverse direction, the first passages 1213 are extending along the mating direction, i.e., the front-to-back direction, and extending through the base portion 11. A pair of channels 1214 are defined on lateral sides of the first passages 1213 to receive the latches 4, and the channels 1214 are extending through the base portion 11.

Similar to the first tongue 121, the second tongue 122 defines a number of second passages 1223 parallel to the first passages 1213, and the second passages 1223 are extending through the base portion 11.

The contacts 2 stamped and formed from sheet metal, include a plurality of first contacts 21 and a plurality of second contacts 22, and the first contacts 21 are received in the corresponding first passages 1213 with the second contacts 22 received in the corresponding second passages 1223. The first contacts 21 are compatible to version 2.0 Micro Universal Serial Bus. Each contact 2 comprises a contacting portion 23 extending along the mating direction, a retaining portion 24 extending rearwards from the contacting portion 23, and a tail portion 25 bent downwards or upwards from the retaining portion 24. A lateral surface of the contacting portion 23 is located in a vertical plane and a bottom surface of the tail portion 25 is located in a horizontal plane.

The first contacts 21 include five conductive contacts, and one of the first contacts 21 in the middle thereof is a signal contact 211, and the signal contact 211 has a special rear section different from others. The signal contact 211 comprises a main body 2110 located in a vertical plane perpendicular to the horizontal level, a soldering portion 2112 located in a horizontal plane perpendicular to the vertical plane and a connecting portion 2114 linking the main body 2110 with the soldering portion 2112. The soldering portion 2112 is located outside of the tail portions 25 of other first contacts 21. The main body 2110 comprises a front contacting portion 23, a rear board portion 26, and a retaining portion 24 connected with the front contacting portion 23 and the rear board portion 26, the board portion 26 has a bigger dimension. The connecting portion 2114 is bent from a bottom edge of the main body 2110, and extending in a horizontal level firstly, that is to say, the horizontal part of the connecting portion 2114 is vertical to the main body 2110, then the connecting portion 2114 is bent upwards to be parallel to the main body 2110, so the connecting portion 2114 is extending horizontally firstly and then vertically, and of a L-shaped configuration. Obviously, the soldering portion 2112 and the connecting portion 2114 are together structured in a Z-shaped configuration viewed in a front-to-back direction. The first contacts 21 except the signal contact 211 are equally divided into two pairs by the board portion 26 of the signal contact 211.

The second contacts 22 also have five conductive contacts, and the one in middle of the second contacts 22 is a grounding contact 221, and the grounding contact 221 has the same configuration as the signal contact 211, the description of the grounding contact 221 is omitted. A main body of the grounding contact 221 also comprises a front contacting portion 23, a rear board portion 26, and a retaining portion 24 connected with the front contacting portion 23 and the rear board portion 26. The board portion 26 of the grounding contact 221 is sandwiched between a pair of second contacts 22 receiving high speed data and a pair of second contacts 22 transmitting high speed data, to prevent cross-talk.

The metallic shell 3 includes a shielding member 31, a bottom shell 32 and a top shell 33. The shielding member 31 comprises a sleeve portion 311 in the front thereof and a plurality of locking portions 312 extending rearwards from the sleeve portion 311, and each locking portion 312 has a through hole 3120. A pair of the locking portions 312 on an upper side are arranged side by side closely, and the other one locking portions 312 is spaced apart from the pair of the locking portions 312 to form a vacant area. A pair of legs 313 are extending rearwards from the sleeve portion 311, and disposed in the vacant area in a back to back manner. The sleeve portion 311 defines a depression 3112 relative to a gap between the first front segment 1212 and the second front segment 1222, and the depression 3112 is divided the sleeve portion 311 into two mating cavities 3113 for receiving the first tongue 121 and the second tongue 122. The sleeve portion 311 defines a pair of notches 3114 receiving the latches 4.

The bottom shell 32 comprises an engaging portion 321 with a tube shape, the engaging portion 321 has a joining line 3210 on an upper wall thereof, a plurality of apertures 3211 are defined behind the engaging portion 321, and a positioning hole 3212 is disposed in front of the apertures 3211. The bottom shell 32 also has another positioning hole 3212 on a lower wall thereof. Furthermore, the bottom shell 32 defines a pair of stopping flanges 323 on front ends thereof, and the stopping flanges 323 are opposite to each other.

The top shell 33 is cooperated with a rear section of the bottom shell 32, and comprises a pair of slits 331 on both sides and a plurality of teeth 332 on a front edge. The teeth 332 are inserted into the corresponding apertures 3211 of the bottom shell 32 to make the top shell 33 be fastened to the bottom shell 32.

Each latch 4 comprises a retaining standoff 41 held in the base portion 11 of the insulative housing 1 and an engaging arm 42 extending forwards from the retaining standoff 41, the engaging arm 42 is received in the relative channel 1214 of the insulative housing 1.

The spacer 5 is made of insulative material, and comprises a primary portion 51 and a pair of elongate arms 52 extending forwards from lateral side of the primary portion 51. Each elongate arm 52 defines a tuber 521 on a front end thereof for assorting with the corresponding lateral wall 113 of the insulative housing 1. The primary portion 51 defines a pair of protrusions 512 protruding outside, and the two protrusions 512 have different sizes with each other. Each protrusion 512 defines a gateway 5120 recessed from a front end thereof along a front-to-back direction, and a cutout 5121 is defined on a lateral wall of the protrusion 512 and communicated with the gateway 5120. The gateway 5120 is defined in a vertical direction, and the cutout 5121 is defined along a horizontal direction and extending through the lateral wall of the protrusion 512, but the gateway 5120 isn't extending through the protrusion 512 completely. The primary portion 51 defines a plurality of grooves 513 on a top surface and a bottom surface respectively for receiving the tail portions 25 of the contacts 2.

The cable 6 comprises a number of wires 61, and each wire 61 has an inner conductor 611 and an insulative outer jacket 612.

Referring to FIGS. 6-9, in assembly, the contacts 2 are inserted into the insulative housing 1 along a back-to-front direction, the first contacts 21 and the second contacts 22 are accommodated in the first passages 1213 of the first tongue 121 and the second passages 122 of the second tongue 122 respectively, the latches 4 are inserted into the channels 1214 of the first tongue 121. Then the spacer 5 is assembled to a back end of the insulative housing 1 along the back-to-front direction, the elongate arms 52 on both sides of the spacer 5 are sliding in the first slots 1131 of the insulative housing 1, until the tubers 521 of the elongate arms 52 locked in the second slots 1132. A block 53 on a front end of the spacer 5 is interferentially cooperated with an indentation (not labeled) on the back end of the insulative housing 1.

The board portions 26 of the signal contact 211 and the grounding contact 221 are inserted into and enclosed in the gateways 5120 of the spacer 5, the connecting portions 2114 are received in the cutouts 5121, and the tail portions 25 of the contacts 2 are located in the corresponding grooves 513 of the spacer 5. The wires 61 of the cable 6 are soldered to corresponding tail portions 25 of the contacts 2.

Then the insulative housing 1 is assembled into the shielding member 31, the tongue portion 12 of the insualtive housing 1 is received in the sleeve portion 311 of the shielding member 31, and the first tongue 121 and the second tongue 122 are received in the mating cavities 3113 respectively. The two mating cavities 3113 can prevent the first and second front segment 1212, 1222 swaying. The engaging arms 42 of the latches 4 are received in the notches 3114 and exposed out of the shielding member 31. The first tabs 1112 and the second tabs 1122 of the insulative housing 1 are inserted into the corresponding through holes 3120 of the shielding member 31. The legs 313 extending from the back end of the shielding member 31 are inserted into the locking hole 115 to enhance the combination between the shielding member 31 and the insulative housing 1. Then the bottom shell 32 is enclosing the aforementioned elements, the third tabs 114 on the insulative housing 1 are received in the corresponding positioning holes 3212 of the bottom shell 32, and the stopping flanges 323 of the bottom shell 32 are adjacent to the front end of the base portion 11 of the insulative housing 1. Then the top shell 33 is assembled to the bottom shell 32 along an up-to-down direction, The teeth 332 of the top shell 33 are latched in the corresponding apertures 3211 of the bottom shell 32, to make the conjunction between the shielding member 31, the bottom shell 32. the top shell 33 and the insulative housing 1 stable, thus, the cable connector assembly 100 is assembled.

The cable connector assembly 100 is compatible to standard USB 2.0 connector. The size of the first tongue 121 and the arrangement of the first contacts 21 are in accordance with USB 2.0 plug connector standard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising: an insulative housing including a base portion, a first tongue and a second tongue extending forwards from the base portion and located side by side with thereof corresponding bottom surfaces on a same horizontal level; a plurality of contacts received in the insulative housing, and comprising a plurality of first contacts held in the first tongue and a plurality of second contacts held in the second tongue; a metallic shell enclosing the insulative housing; and a spacer assembled to the insulative housing and supporting the contacts; wherein at least one of the contacts comprises a main body located in a vertical plane perpendicular to the horizontal level, a soldering portion located in a horizontal plane perpendicular to the vertical plane and a connecting portion linking the main body with the soldering portion, the main body is extending along a mating direction, the spacer has a gateway recessed backwards, and a rear board portion of the main body is inserted into the gateway.

2. The cable connector assembly as claimed in claim 1, wherein the main body further comprises a front contacting portion, and a retaining portion connecting with the front contacting portion and the rear board portion.

3. The cable connector assembly as claimed in claim 1, wherein the connecting portion is of L-shaped, and extending from the main body horizontally firstly and then bent to extend vertically.

4. The cable connector assembly as claimed in claim 1, wherein the spacer defines a protrusion protruding outside and a plurality of grooves receiving the contacts, and the gateway is defined in the protrusion.

5. The cable connector assembly as claimed in claim 4, wherein the protrusion also has a cutout communicated with the gateway, and the cutout is defined on a lateral wall of the protrusion along a horizontal direction.

6. The cable connector assembly as claimed in claim 5, wherein the gateway and the cutout aren't extending rearwards through the protrusion completely, and the gateway isn't extending through the protrusion along a vertical direction.

7. The cable connector assembly as claimed in claim 4, wherein two pairs of contacts are equally disposed on both sides of the protrusion.

8. The cable connector assembly as claimed in claim 1, wherein the metallic shell defines a pair of legs extending backwards, the insulative housing defines a locking hole recessed from a front end of the base portion, and the legs are inserted into the locking hole in a back to back manner.

9. A cable connector assembly, comprising: an insulative housing having a first tongue and a second tongue located side by side with thereof corresponding bottom surfaces on a same horizontal level; a plurality of contacts mounted in the insulative housing; a metallic shell having two mating cavities, the first tongue and the second tongue received in the corresponding mating cavities; and a spacer latched with the insulative housing; wherein the spacer has at least one protrusion, and the protrusion defines a gateway recessed along a front-to-back direction and a cutout communicated with the gateway, at least one of the contacts is inserted into the gateway and the cutout.

10. The cable connector assembly as claimed in claim 9, wherein the gateway is defined along a vertical direction perpendicular to horizontal level, and the cutout is disposed perpendicular to the gateway.

11. The cable connector assembly as claimed in claim 9, wherein the contact comprises a main body located in a vertical plane perpendicular to horizontal level, a soldering portion located in a horizontal plane perpendicular to vertical plane and a connecting portion linking the main body with the soldering portion.

12. The cable connector assembly as claimed in claim 9, wherein the cutout is defined on a lateral wall of the protrusion.

13. The cable connector assembly as claimed in claim 9, wherein the metallic shell defines a pair of legs extending backwards, the insulative housing defines a locking hole recessed rearwards, and the legs are inserted into the locking hole in a back to back manner.

14. A cable connector assembly comprising: an insulative housing defining a plurality of passageways side by side arranged with one another along a transverse direction; a plurality of contacts disposed in the corresponding passageways, respectively, each of said contacts stamped and formed from sheet metal and having a retention section, and a contacting section with thereof a corresponding lateral surface essentially extending in a vertical plane perpendicular to the transverse direction and a soldering section defining a bottom surface extending in a horizontal plane perpendicular to the vertical plane under condition that a middle one of said contacts defining an L-shaped structure linked between the retention section and the soldering section; and an insulative spacer located behind and attached to the housing to support the L-shape structure.

15. The cable connector assembly as claimed in claim 14, wherein the soldering sections of said middle one of the contacts is spaced, in said transverse direction, from the vertical plane of said middle one of the contacts with another soldering section of another contact adjacent to said middle one of the contacts.

16. The cable connector assembly as claimed in claim 15, wherein said L-shaped structure includes a horizontal section essentially located above the soldering sections of said another contact in a vertical direction perpendicular to said transverse direction.

17. The cable connector assembly as claimed in claim 14, wherein the soldering section of the middle one of the contacts and the associated L-shaped structure commonly define a Z-shaped configuration viewed in a front-to-back direction perpendicular to said transverse direction.

18. The cable connector assembly as claimed in claim 14, wherein the spacer defines a horizontal platform to support the soldering sections of the corresponding contacts.

19. The cable connector assembly as claimed in claim 14, wherein the middle one of the contacts defines an enlarged vertical section with thereof a lateral surface located in said vertical plane behind the retention section, and the soldering sections of the remaining contacts rearwardly extend not beyond said enlarged vertical section in a front-to-back direction perpendicular to said transverse direction.

20. The cable connector assembly as claimed in claim 14, wherein each of said contacts has the corresponding soldering section seated upon the spacer and a corresponding vertical section located behind the retention section and received in the spacer.

* * * * *